US011383876B2

(12) United States Patent
Thompson et al.

(10) Patent No.: US 11,383,876 B2
(45) Date of Patent: Jul. 12, 2022

(54) PORTABLE HANDLE ASSEMBLY

(71) Applicant: Anheuser-Busch InBev S.A., Brussels (BE)

(72) Inventors: Keenan Thompson, Leuven (BE); Wim Dekocker, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 17/252,334

(22) PCT Filed: Jun. 17, 2019

(86) PCT No.: PCT/EP2019/065915
§ 371 (c)(1),
(2) Date: Dec. 15, 2020

(87) PCT Pub. No.: WO2019/238977
PCT Pub. Date: Dec. 19, 2019

(65) Prior Publication Data

US 2021/0269192 A1 Sep. 2, 2021

Related U.S. Application Data

(60) Provisional application No. 62/685,754, filed on Jun. 15, 2018.

(30) Foreign Application Priority Data

Jun. 15, 2018 (BE) ..... 2018/5408

(51) Int. Cl.
*B65D 5/46* (2006.01)

(52) U.S. Cl.
CPC ..... *B65D 5/46024* (2013.01)

(58) Field of Classification Search
CPC .. B65D 5/46008–4604; B65D 5/46192; B65D 2571/00469; B65D 2571/00512
(Continued)

(56) References Cited

U.S. PATENT DOCUMENTS 2,401,664 A * 6/1946 Robins ..... B65D 5/46024 229/117.19
2,868,433 A 1/1959 Anderson, Jr.
(Continued)

FOREIGN PATENT DOCUMENTS

DE 1286714 B * 1/1969 ..... B65D 5/46024
DE 1286714 B 1/1969
(Continued)

OTHER PUBLICATIONS

Machine Translation of DE 3225824 (Year: 1984).*
WIPO, ISR for PCT/EP2019/065915, dated Jul. 19, 2019.

*Primary Examiner* — Nathan J Newhouse
*Assistant Examiner* — Phillip D Schmidt
(74) *Attorney, Agent, or Firm* — Hodgson Russ LLP

(57) ABSTRACT

The present disclosure provides a portable handle assembly for use with one or more secondary packages. The handle assembly includes a base portion. The base portion includes a first handle pocket at a proximal end extended towards a second handle pocket at a distal end. Each of the handle pocket includes a recess having an inward opening and an outward opening. The handle assembly further includes a handle having a gripping portion extended towards a first enclosed portion at the proximal end and towards a second enclosed portion at the distal end. Each of the enclosed portions is adapted to be received within the recess of at least one of the handle pocket such that it is slidingly clamped there within. When a user grasps the handle by lifting up the
(Continued)

gripping portion, at least one of the enclosed portion slides out to a locked state and moves back.

17 Claims, 11 Drawing Sheets

(58) Field of Classification Search
USPC ..... 229/117.09, 117.14, 117.22–117.24; 220/762
See application file for complete search history.

(56) References Cited

U.S. PATENT DOCUMENTS

| | | | | |
|---|---|---|---|---|
| 3,030,002 | A * | 4/1962 | Ringler | B65D 5/46016 229/117.24 |
| 3,692,202 | A * | 9/1972 | Parlagreco | B65D 17/4011 220/276 |
| 4,339,070 | A * | 7/1982 | Davies | B65D 5/723 229/117.24 |
| 4,905,888 | A | 3/1990 | Suoss et al. | |
| 6,220,506 | B1 * | 4/2001 | Knight | B65D 5/46008 229/103.1 |
| 10,287,060 | B1 * | 5/2019 | Kuesel | E04G 21/201 |
| 2007/0199837 | A1 * | 8/2007 | Justice | B65D 5/721 206/215 |
| 2008/0010945 | A1 | 1/2008 | McKenna et al. | |
| 2015/0108153 | A1 | 4/2015 | Faber | |

FOREIGN PATENT DOCUMENTS

| | | | | |
|---|---|---|---|---|
| DE | 3225824 | A1 * | 1/1984 | B65D 5/723 |
| DE | 4425754 | A1 * | 1/1996 | B65D 5/46192 |
| DE | 20305535 | U1 | 8/2003 | |
| FR | 850391 | A | 12/1939 | |
| FR | 2734544 | A1 * | 11/1996 | A45C 13/26 |
| FR | 3009715 | A1 * | 2/2015 | B65D 5/46192 |
| KR | 102180312 | B1 * | 11/2020 | |
| WO | WO-9408856 | A1 * | 4/1994 | B65D 5/4604 |
| WO | 9627538 | A1 | 9/1996 | |
| WO | 2012142559 | A1 | 10/2012 | |

* cited by examiner

METHOD 600

METHOD 700

PORTABLE HANDLE ASSEMBLY

TECHNICAL FIELD

The present disclosure generally relates to a handle assembly and particularly to a portable handle assembly for use with secondary packages.

BACKGROUND

In the recent years, there has been a many-fold increase in the trend of grouping large number of items such as food item including liquid foods, home essentials, stationary items, and the like, in the form of multipacks, for various purposes such as to enable bulk selling, easy transportation, handling, and the like. For example, single serving containers (e.g., cans or bottles) are commonly packaged in groups of six or twelve for sale to consumers. Additionally, various different items are also packaged together within a single secondary package for various reasons.

Numerous carrying mechanisms have been developed for such packages including multipacks as well as other secondary packages. generally made of paperboard and/or cardboard and/or plastic material. For cost and environmental considerations, such packages need to be formed from as little material as possible and cause as little wastage in the materials from which they are formed as possible. Accordingly, it may well be concluded that there has been a significant shift in packaging a grouping of individual containers or products together and is highly desired by consumers as well.

For convenient carrying these secondary packages, various types of hand-grasps are known. For example, it is known to provide hand gripping apertures to facilitate carrying the packages. However, such hand grasping holes are not comfortable and also requires both hand to be used for holding the package, and therefore is not preferred. Further in some instances, a shrink film having a handle hole was wrapped around the packages. Such handle holes within the shrink film were utilized to grip and lift the packages. However, such shrink film-based handle has several disadvantages such as that, because of being wrapped around the container, it had to be torn for opening the package and therefore is not utilizable once the package is opened. Further, these being made of light weight film were more prone to breakage, tearing away due to the weight of the packages and therefore were not preferred.

Accordingly, it was desirable to provide a carrying handle that is both comfortable to use and strong enough to bear the load of the package contents.

In some instances, packages with integral handles was provided. One such package is disclosed in U.S. Pat. No. 2,868,433 which discloses a receptacle with an integral handle formed of two layers of paperboard to carry the receptacle and the content stored therein. Such packages, however had several disadvantages. One disadvantage is double thickness of material for the handle requires the use of more packaging material. Further, these cartons may have varying thickness which may be unstable when stacked for storage, shipment and display.

In some other developments, a multipack with strap and/or tape based carrying handles were provided. For example, WO Publication No. 96/27538 discloses a carton having a strap handle which is joined at either end to the side walls of the carton. However, these handles were not suitable for carrying heavy containers because when the handle is deployed the load contained in the carton is transmitted to these joints. Such a load onto the joint may cause detachment of handles from the carton and therefore tend to break frequently In yet other instances, a plastic handle was externally adhered to an upper end of the multipack. Whilst such plastic handles provide a suitable carrying handle for the packages, these handles being separate component externally attached, were also prone to breakage on application of heavy loads and also actually be ripped away at their attachment points during transportation. Further, these handles including all the externally attachable handle had an additional disadvantage that stacking of such packages and/or loading them onto palettes was not possible due to presence of these external handles.

Numerous efforts have therefore been lately imparted to produce a handling mechanism which overcome the above-mentioned problems, by providing handles which are attached/connected to the packages from inside of the packages and remains within the package when not in use, therefore are not damaged during transportation.

For example, U.S. Pat. No. 4,905,888 discloses a handle which is integrated into the package wall. The handle has a shape defined by a perforated tear line in the wall. Particularly, the handle is attached to the wall by means of a carrying tape attached to the inner surface of the wall and the inner surface of the handle. Such a carrying the further provides a freely moving, strap-type, foldable tape sections formed between the end sections attached to the inner surface of the wall and the middle section of the carrying tape attached to the handle.

U.S. Patent Publication No. 20080010945 discloses a handle assembly for a pourable package having a front panel, a back panel, a bottom panel and opposing side gussets in which each side gusset has an inside wall and an outside wall. The handle assembly includes one or more hand portions, each hand portion having a tab that extends beyond the opening and along the inside wall of the side gusset. The handle assembly further comprises a seal member positioned on the inside wall of the side gusset and around the opening wherein the seal member seals the tabs to the inside wall of the side gusset and seals the opening. Such a handle assembly partially positions within an opening of the side gusset and partially positioned beyond the opening.

U.S. Patent Publication No. 20150108153 discloses a carry handle secured to an inner surface of each end wall of a carton having a bottom wall, opposite side walls, and opposite end walls. The carry handles have a stowed position inside the carton and an extended position outside the carton for lifting and carrying the carton. The carton includes a spacer panel having cutouts in aligned registry with respective carry handles to accommodate the carry handles in their stowed position and to prevent contact between the carry handles and paper in the carton.

Accordingly, as also can be noted from above examples, currently, and most recently, the handle installed within the walls of the packages, and including a hand grip accessible through an opening within the package, to conveniently hold the packages is provided. However, such handle is having some short comings such as they impart a lot of pressure on the wall to which they are connected and therefore tend to tear the light weight wall, generally made of paper. Further, most of them are applicable to very light weight as they have no mechanism for avoiding and safeguarding the grip portion against the heavy load. Additionally, these handles are very complex to be installed and therefore difficult for use by an ordinary consumer.

Accordingly, as discussed above, various kind of handles have been developed for such secondary packages. These handle structure includes various kind of handles such as strap-like members, integral, paperboard handle elements articulated to one of the box walls, and separate handle elements attached to the inside of the packages. However, all such handle structure has some kind of shortcomings. Further, these handle constructions add significantly to the cost of cartons/packages while being inherently unsatisfactory, particularly when any heavy load of contents is to be carried within the packages/cartons.

As can be seen from the foregoing discussion, there still exists a need for an improved handle structure for secondary packages which while being cost effective, comfortable and strong, is easy to be used by an ordinary consumer.

SUMMARY

In one aspect of the present disclosure, a portable handle assembly is provided. The handle assembly includes a base portion. The base portion includes a first handle pocket at a proximal end extended towards a second handle pocket at a distal end. Each of the handle pocket includes a (horizontal) recess having an inward opening and an outward opening. The handle assembly further includes a handle having a gripping portion extended towards a first enclosed portion at the proximal end and towards a second enclosed portion at the distal end. Each of the enclosed portions is adapted to be received within the recess of at least one of the handle pocket such that it is slidingly clamped there within. In use, when a user grasps the handle by lifting up the gripping portion, at least one of the enclosed portion slides out to a locked state and moves back to a free state when the griping portion is released and retracted back.

Note that the recess of a handle pocket will generally be a 'flat' or 'horizontal' slot of limited height above the base portion, generally extending in direction parallel to the base portion, especially so in relaxed position.

Preferably, the base portion is a generally elongated piece of a material selected from but not limited to all kind of papers, cardboard, carton, fiber board, corrugated board, plastic, and the like. In some embodiments, the base portion may comprise of, or even consist of metal, such as aluminum. Given the high strength and light weight of thin sheets of metal, this could be especially advantageous as the base portion is entirely shielded from the user.

Further preferably, the base portion is a single layer structure.

Alternatively, the base portion may be a multi-layer structure.

Possibly, each of the first pocket and the second pocket is a generally v-shaped hollow pocket.

Further possibly, each of the first pocket and the second pocket is formed by folding and then gluing a piece of a material such that the recess is defined there within.

Yet further possibly, the piece of material is a single layer or a multilayer structure formed of a material selected from but not limited to all kind of paper, cardboard, carton, fiberboard, corrugated board, metal (such as aluminum) and the like.

Yet further possibly, each of the pockets is affixed onto the base portion using one or more fixation mechanism selected from but not limited to gluing, punching, stapling, and the like.

Potentially, the first pocket is affixed onto the base portion a distance Dp from the second pocket.

Further potentially, the distance Dp is generally greater than or equal to a length $L_H$ of handle.

Preferably, each of the first pocket and the second pocket is formed by cutting out two flaps within the base portion and then folding and gluing together the two flaps such that the recess is defined there within.

Further preferably, the two flaps are cut out such that there is a sufficient overlapping between them when folded together.

Generally, each of the first pocket and the second pocket has a minimum width greater than a minimum width and a maximum width greater than a maximum width of each of the enclosed portions of the handle.

Further, each of the enclosed portions is generally v-shaped and of a dimension adapted to be completely fit within the recess of the corresponding handle pocket.

Preferably, the handle may be made of any material selected from but not limited to a single layer or a multilayer structure of all kind of papers, cardboard, carton, fiber board, corrugated board, plastic, and the like. In some embodiments, the base portion may comprise of, or even consist of metal, such as aluminum. Given the high strength and light weight of thin sheets of metal, this could be especially advantageous.

Further preferably, the gripping portion may include finger grips facilitating easy handling thereof by a user.

Optionally, the handle assembly further includes a locking mechanism for limiting the movement of the handle beyond a predetermined position on the base portion.

Further optionally, the locking mechanism may be positioned within each of the first pocket and the second pocket of the handle assembly.

Yet further optionally, the locking mechanism includes a cutout on each end of the gripping portion and a complementary hook for locking the movement of the gripping portion beyond the position of the hook.

Alternatively, the locking mechanism may be any suitable locking mechanism known in the art such as including but not to rivets, thread, buttons, retention tabs, and any other suitable mechanical locking means.

In an alternative aspect, a handle assembly may be provided, the assembly comprising:

- a base portion comprising a handle pocket at a proximal end and extended towards a distal end, said pocket comprising a recess;
- a handle comprising a gripping portion extending towards an enclosed portion at the proximal end and a fixed portion at the distal end
- wherein the enclosed portion is slidingly locked within the handle pocket such that when the gripping portion is lifted up, the enclosed portion slides out to a locked state and moves back to a free state when the griping portion is released and retracted back.

In another aspect of the invention, a secondary package having a portable handle assembly is provided. The secondary package is generally a carton having a plurality of walls including a top wall, a bottom wall and a plurality of sidewalls defining an inner surface there within. The package further includes one or more handle openings/elongated slots configured on at least one of the plurality of walls. The secondary package further includes one or more handle assembly positioned in an inner surface and visibly accessible through the one or more handle openings/elongated slots, for securely and comfortably gripping and/carrying the package. The handle assembly is positioned within the secondary package such that the gripping portion of the handle is accessible through the recessed slot. In use, when a user lifts the package by grasping the handle, the gripping portion slidingly extends out of the elongated slot and retracts back when released by the user.

Generally, the secondary packaging is a carton formed of a material selected from but not limited to a paperboard, a cardboard, plastic, paper, hybrid material, and any combination thereof.

Possibly, the secondary packaging may be of any suitable geometric shape such as cuboidal, cubical, spherical, circular and the like.

Accordingly, in a free state, the gripping portion remains seated within the packaging such that it is visibly accessible there through.

Further, in a lifted state, the gripping portion extends out of the packaging wall due to a force exerted by the user in lifting the package.

A preferred embodiment for both aspects of the invention provides for a base portion which comprises a double-folded section towards the proximal end and positioned between the first handle pocket and the proximal end itself, and/or comprises a double-folded section towards the distal end positioned between the second handle pocket and the distal end itself. The double-folded sections comprise fold lines substantially perpendicular to the longitudinal axis of the base portion, thereby creating an overlapping Z-shaped double-folded section. The double-folded section may be further attached to each other via adhesives (glue, tape, paste, etc.) at one or more points, though preferably at both overlapping zones, whereby the level of adhesion is adapted to allow the double-folded section(s) to function as buffers for high and/or sudden forces on the handle, dissipating some of that force when coming free from the double-folded formation to avoid tearing at the handle pockets. When a sudden and/or high force is exerted, the attachment comes loose, allowing the base portion to become longer by undoing the double-folded formation, thereby reducing the stress on the pocket handles. Additionally, this also allows the handle to be 'hidden', in the sense that it lies flat against the base portion, and thus in/on the secondary packaging, before use. When the user wishes to lift the packaging, the handle then extends and comes free, with the necessary length to allow easy carrying.

Preferably, the base portion is further provided with fold lines towards the proximal and/or distal end, but positioned between the two handle pockets. These allow the handle assembly to be of particular use in containers where the proximal and/or distal end are folded downwards to interface with a side wall of the container when in use.

In possible embodiments, the double-folded sections may be quadruple-folded, and/or two or even more double-folded may be provided towards one or both ends of the base portion.

A preferred embodiment for the handle assemblies of the invention, provides the handle pockets with the inward opening having a smaller dimension than the outward opening (see also in figures), whereby the enclosed portions of the handle having a (geometrically) similar shape as the pockets, and are adapted to fit within the handle pockets. Specifically, the handle pockets increase in width outwardly, at least at the most outwardly lying section of the handle pockets but preferably over the entire handle pockets. This allows the force of the handle when lifted on the handle pockets to be dispersed outwardly, instead of the force of the handle generally coinciding with the orientation of the lateral edges of the pocket handle. The applicant found that by having the force of the handle not running parallel to said lateral edges, the pocket handle withstands the force better, and tearing is avoid. Especially for paper or cardboard, parallel forces prove to be far more troublesome, as the force would focus on only a single point of attachment instead of over a line section of attachment. The redistribution of force that follows from the present embodiment, strongly reduces the danger of tearing, using the relatively high tension resistance of materials such as paper and cardboard, against the tearing resistance of these materials.

Preferably, the handle pockets have a recess that is substantially shaped as an acute trapezoid, preferably as an isosceles trapezoid. Note that the recess is essentially defined by the lateral edges at which the overhanging structure of the handle pocket is connected to the base portion. By connecting the inward ends of each edge and the outward ends of each edge, the recess is therefore generally quadrilateral, but in reality, will be substantially trapezoid due to the inward and outward edges being substantially parallel.

In a particularly preferred embodiment, the handle pockets will have a (truncated) V- or acute/isosceles trapezoid shape with the lateral edges diverging from each other outwardly towards the respective end portion at which they are situated.

Preferably, the handle pocket has (fixed) lateral edges which are oriented under a minimal outward angle of 10° with respect to the longitudinal axis of the base portion. More preferably, the minimal outward angle is 15°, or even 20°. In some embodiments, the minimal outward angle may even be 25° or 30°.

Preferably, the handle pocket has lateral edges which are oriented under a maximal outward angle of 60° with respect to the longitudinal axis of the base portion. More preferably, the maximal outward angle is 55°, 50°, 45°, 40°, or even 35° or 30°.

We note that the above embodiments are particularly convenient for being produced by cutting flaps from the base portion in order to make the pocket handles, as discussed in the document. This way, the attachment of the pocket handle is directly to the base portion and therefor stronger, without an intermediary such as glue or adhesives attaching the pocket handle to the base portion.

Furthermore, this is highly synergistic when combined with the cut-out flaps. The outward angle mentioned above cannot be too high, or the flaps are hard to attach to each other, or attached over a small surface. However, a high angle is desirable as it better distributes the forces exerted on the handle pocket. It is in this light that the above ranges have proven to be particularly advantageous, as they both ensure good fixation of the flap to each other, as well as a good distribution of force.

In a preferred embodiment, the lateral edges over which the handle pockets are attached to the base portion generally point towards the corners of the base portion in flattened mode.

In a preferred embodiment, the lateral edges over which the handle pockets are attached to the base portion each have a minimal length of 3.0 cm, preferably at least 4.0 cm, more preferably at least 5.0 cm.

In a particularly preferred embodiment, the base portion of the handle assembly is provided with two or more, preferably three, four, five or more, of fold lines perpendicular to the longitudinal direction thereof, preferably in close proximity to each other, on the proximal and/or the distal end (preferably both), whereby the handle pockets are positioned more extremal than the fold lines on the respective ends. In particular, such an embodiment is suitable for handle assemblies adapted for secondary packaging wherein the dimensions of the top plane (to be understood: in the direction along which the handle assembly would extend) are longer than the base portion and larger specifically the distance between the fold lines. In these particular embodiments, the base portion is adapted to be positioned both against the top of the secondary packaging, as well as folding against one or two (oppositely positioned) sidewalls of the secondary packaging, whereby the base portion can be attached (adhesive, fixation means, etc.) to said top and/or sidewalls. In this formation, the handle pockets are positioned at the section of the base portion that is positioned against the sidewalls of the secondary packaging, whereby the (90°) corner from top wall to sidewall forms an obstacle for the transference of force when lifting the handle. FIG. 9 shows a particular embodiment of the handle assembly where virtual demarcations (scored lines 216) are provided indicating the sections of the base portion that are to be folded against the sidewalls (left of leftmost scored line 216 and right of rightmost scored line 216), and the section between the scored lines is to be positioned against the top of the secondary packaging. Note that said demarcation does not necessarily translate in any visible aspect on the base portion, and merely serves as a guide. The fold lines 217 as discussed are also visible in said most extremal sections which are to be folded against (and attached to) the sidewalls. Note that in case of a more gradual transition of the sidewall to the top of the secondary packaging, the demarcations can be considered to reflect a section where the top of containers held in the secondary packaging adjoins the base portion.

Additionally, the fold lines are provided in the section of the base portion that is positioned against the side walls, and acts as a further back-up to ensure the base portion does not separate entirely from the secondary packaging when faced with high force or pressure. As mentioned, the extremal sections of the base portion, which are to be folded against the sidewalls of the secondary packaging, are attached to said sidewalls via adhesives or other fixation means. However, in the event the attachment is loosened, for instance via excessive and/or very sudden force, the fixation may be overcome, resulting in the extremal portions, where the handle pockets are positioned, to tear free from the secondary packaging. While this could lead to the handle pockets being pulled all the way through the slot of the packaging through which the handle extends in 'normal' embodiments (where the base portion does not fold against sidewalls), the above embodiment creatively overcomes this problem. In first instance, the handle pockets can create a blockage at the corner from sidewall to top of the secondary packaging, leading to a bunch-up that can overcome the sudden/extreme force. However, most practically are the fold lines between the handle pocket and the corner from sidewall to the top. When pulled suddenly/forcefully, the base portion will fold along the fold lines, creating a (multiply) folded section between handle pocket and the corner, which will 'clog' or 'bunch' up the limited space that is available at the corner, thereby not allowing the base portion to be pulled entirely away from the sidewalls and thus avoiding catastrophical failure of the handle assembly. Furthermore, it is to be noted that in some embodiments, the secondary packaging has a rounded interface between the top and sidewalls. In such a case, it is to be understood that the demarcation (scored lines 216) shows the region where the side walls of the secondary packaging and the top section of the containers (generally the top seam or rim of the held container) held therein interface with each other. It is at this interface where there is limited margin between secondary and primary packaging, and where the constriction due to the folded lines 217 will cause the base portion to get stuck before the handle pockets can slip through.

The number of said fold lines can vary, as well as their mutual orientation, mutual distance, etc. Preferably, the fold lines are suitable proximate to each other, for instance distanced maximally by 2.0 cm or 1.5 cm, preferably maximally 1.0 cm, or even 0.75 cm, or 0.6 cm, 0.5 cm, 0.4 cm or less. In an embodiment, the fold lines can be mutually parallel (and substantially perpendicular to the longitudinal axis of the base portion (from proximal to distal end). Alternatively, subsequent fold lines are not parallel and are presented at slight angles with respect to each other, at most 30°, preferably at most 25°, more preferably at most 20° or 15°, or even at most 10° or 5°. Said angle is preferably at least 1°, more preferably at least 3° or even 5°.

In yet another aspect of the invention, a method for assembling the secondary package having a handle assembly as disclosed above is provided. The method includes receiving and/or forming a secondary package. The method further includes placing a plurality of items such as for example, beverage containers, within the inner surface of the secondary package arranged in a predetermined row and column configuration. The method further includes positioning the handle assembly within the secondary package such that the gripping portion is accessible from the handle opening/elongated slot. In use, when a user lifts the package, the gripping portion is slidingly extended out of the secondary package thereby supporting the load of the package using the enclosed portions, the handle pockets, base portion and the corresponding wall of the package.

Optionally, each of the step of the method may be performed in any desired order.

Further optionally, the method further includes the step of fixing the base portion of the handle assembly onto an inner surface of the wall having the elongated slot/handle opening.

Alternatively, the method includes supporting the base portion of the handle assembly within the secondary package on the top of the items such as beverage containers placed therein.

The details of one or more implementations are set forth in the accompanying drawings and the description below. Other aspects, features and advantages of the subject matter disclosed herein will be apparent from the description, the drawings, and the claims.

DETAILED DESCRIPTION

As required, a schematic, exemplary-only embodiment of the present application is disclosed herein; however, it is to be understood that the disclosed embodiment is merely exemplary of the present disclosure, which may be embodied in various and/or alternative forms. Specific structural and functional details disclosed herein are not to be interpreted as limiting, but merely as a basis for the claims and as a representative basis for teaching one skilled in the art to variously employ the present disclosure in virtually any appropriately detailed structure.

Aspects, advantages and/or other features of the exemplary embodiment of the disclosure will become apparent in view of the following detailed description, which discloses various non-limiting embodiments of the invention. In describing exemplary embodiments, specific terminology is employed for the sake of clarity. However, the embodiments are not intended to be limited to this specific terminology. It is to be understood that each specific portion includes all technical equivalents that operate in a similar manner to accomplish a similar purpose.

Exemplary embodiments may be adapted for many different purposes and are not intended to be limited to the specific exemplary purposes set forth herein. Those skilled in the art would be able to adapt the exemplary-only embodiment of the present disclosure, depending for example, on the intended use of adapted embodiment. Moreover, examples and limitations related therewith brought herein below are intended to be illustrative and not exclusive. Other limitations of the related art will become apparent to those of skill in the art upon a reading of the following specification and a study of the related figures.

The present application discloses a portable handle assembly for use with one or more secondary packages, for holding a plurality of items such as beverage containers enclosing liquids such as cold drinks, beer, wines, mineral water etc. The handle while being portable is comfortable for being held by a user and is strong enough to carry the heavy loads of the secondary packages without breaking there through. It should be understood that embodiments of the present invention may be applied in combination with various type of packages irrespective of size, shape and materials, used in the beverage industry. Further, the present invention may be used in any other industry for facilitating easy handling of one or more packages, items grouped in a single package, without deviating from the scope of the invention. It must also be noted that, as used in this specification and the appended claims, the singular forms "a," "an" and "the" include plural referents unless the context clearly dictates otherwise. Thus, for example, the term "an opening" is intended to mean a single opening or a combination of openings, "a sidewall" is intended to mean one or more sidewalls, or a combination thereof.

Figure 1:
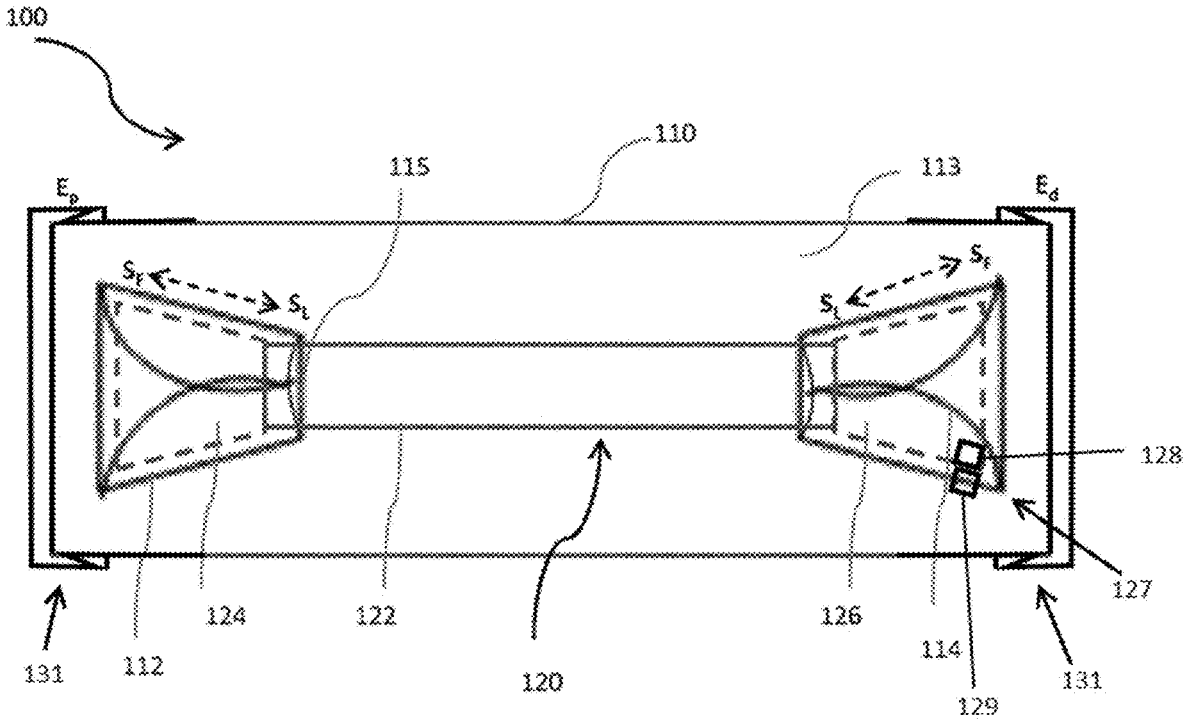
FIG. 1 illustrates a schematic diagram representing a handle assembly, in accordance with a preferred embodiment of the present disclosure.

FIG. 1 illustrates a schematic diagram displaying basic components of the handle assembly of the present disclosure. As illustrated in FIG. 1, the present disclosure provides a handle assembly 100 for use with one or more secondary packages [not shown] holding a plurality of items such as beverage containers, food items, house hold essentials, and the like. The handle assembly 100 includes a base portion 110. The base portion 110 includes a first handle pocket 112 at a proximal end $E_p$ extended towards a second handle pocket 114 at a distal end $E_d$, configured on an upper surface 113 thereof. Each of the first handle pocket 112 and the second handle pocket 114 includes a recess 115. The base portion may further include a double-folded section 131 towards the proximal end $E_p$ and positioned between the first handle pocket 112 and the proximal end $E_p$ itself, and a double-folded section 131 towards the distal end $E_d$ positioned between the second handle pocket 114 and the distal end itself $E_d$. The double-folded sections 131 may include fold lines substantially perpendicular to the longitudinal axis of the base portion 110, thereby creating an overlapping Z-shaped double-folded section 131. At least one overlapping zone of the double-folded section 131 may be releasably interconnected to each other via an adhesive or fixation means. The handle assembly 100 further includes a handle 120 having a gripping portion 122 extending between a first enclosed portion 124 at the proximal end $E_p$ and a second enclosed portion 126 at the distal end one $E_d$. Each of the enclosed portions 124, 126 is adapted to be slidably and lockingly receivable within at least one of the recess 115 such that each of the enclosed portions 124, 126 is slidingly movable within the corresponding pockets 112, 114 between a free state $S_F$ and a locked state $S_L$. In use, when a user lifts the handle 120, the gripping portion 122 is lifted upward and each of the enclosed portions 124, and 126 slidingly extends out towards a position where it is in its locked state $S_L$ within the corresponding pockets 112, 114 such that the force applied the user is shared between the enclosed portions 124, 126, the pockets 112, 114, and the base portion 110. When the user release the handle 120, the gripping portion 122 retracts back and the enclosed portions 124, and 126 slides back to its free state $S_F$ within the corresponding pockets 112, 114.

The handle assembly 100 of the current disclosure 120 is generally configured to be installed within a secondary package holding a plurality of items, either as a multipack or as a group of items packed together.

Figure 2A:
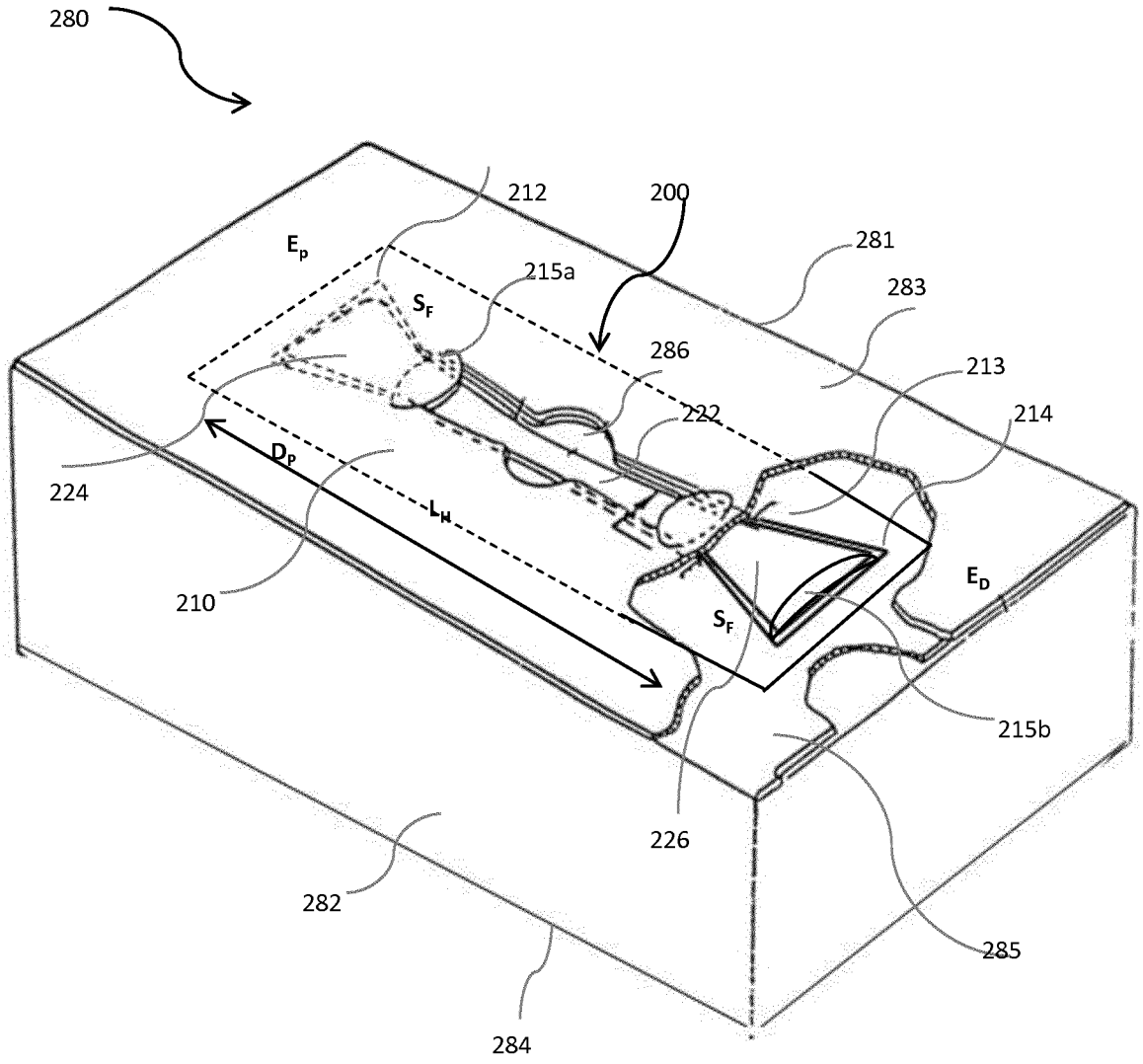
FIG. 2*a* illustrates a schematic diagram representing an exemplary packaging having a handle assembly in a free state, in accordance with a first embodiment of the present disclosure.
Figure 2B:
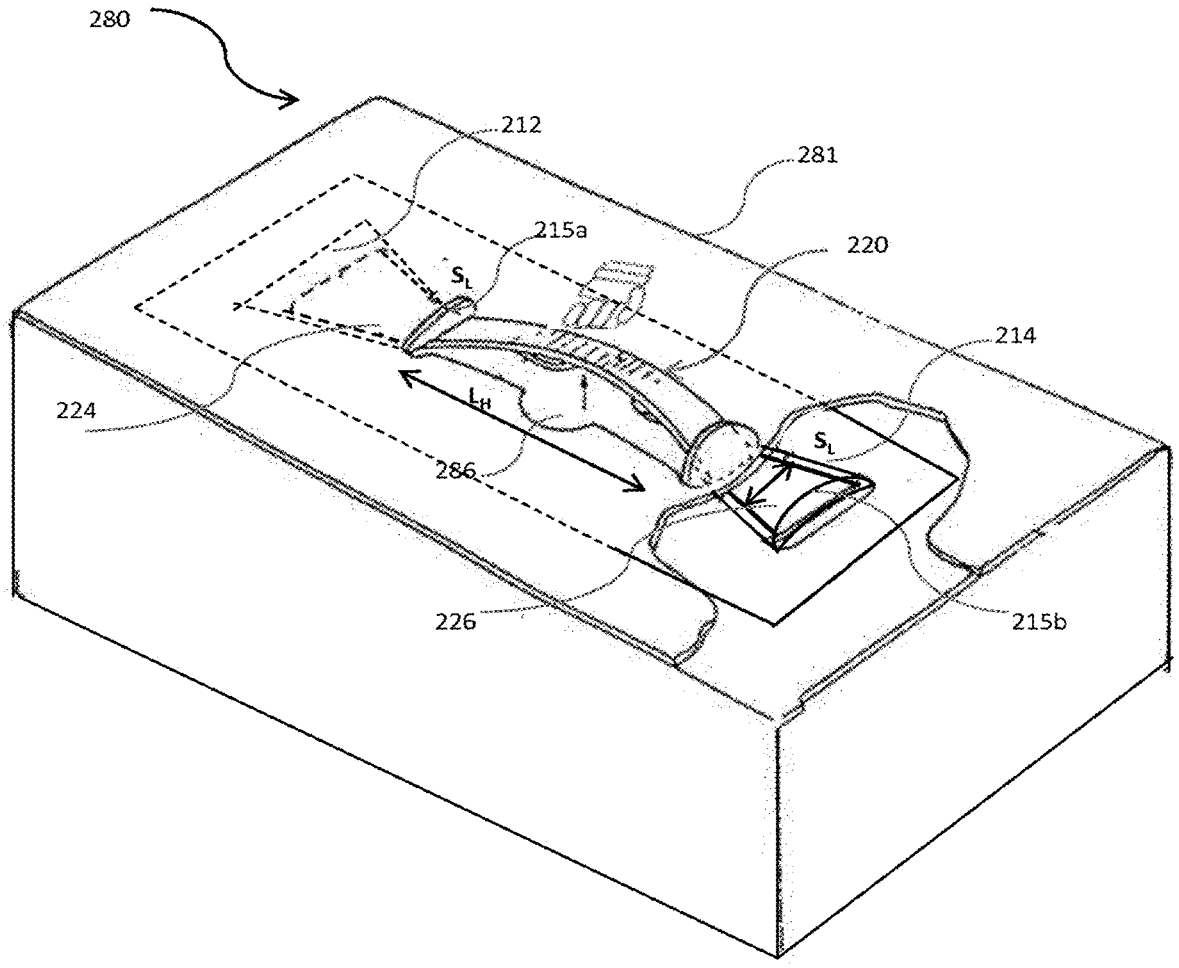
FIG. 2*b* illustrates a schematic diagram representing an exemplary packaging having a handle assembly in a locked state, in accordance with the embodiment of the present disclosure.

In description of the FIGS. 2-3 that follow, elements common to the schematic system will have the same number designation unless otherwise noted. In a first embodiment, as illustrated in FIGS. 2*a* and 2*b*, a secondary package 280 employing a handle assembly 200 is provided. In a preferred embodiment, secondary package 280 includes a carton 281 having a plurality of sidewalls 282 extending between a top wall 283, and a bottom wall 284, defining an inner surface 285 there within. The carton 281 further includes one or more handle openings 286 configured within one or more of plurality of walls 282. The handle assembly 200 is generally adapted to be received and positioned within the inner surface 285 such that it is visibly accessible from the handle opening 286. Accordingly, the handle opening 286 is generally an elongated slot having a length $L_H$ generally dependent upon the dimensions of the handle assembly 200. However, in other embodiments of the present invention, the handle opening 286 may be shaped into any desired shape suitable to provide an access to the handle assembly 200 and may also depend upon the design constraints related thereto, which will be discussed later.

In a preferred embodiment, the carton 281 is generally formed from a folded blank [not shown] for holding a plurality of generally cylindrical shaped beverage containers. Further, the shape and size, including the height of the carton 281 may be varied depending on the design constraints and requirements for its application. For example, within the instances when the 281 is adapted to house twelve containers in one layer in a 3×4 arrangement the carton is dimension accordingly. Further, in other instances, the carton may be sized and shaped to hold containers of a different or same quantity in a single layer, more than two layers, and/or in different row/column arrangements (e.g., 1×6, 3×6, 2×6, 4×6, 2×3×4, 2×6×2, 2×9, 3×5, 3×5×2, etc.).

While the secondary package 280 has been displayed in the form of a carton 281 as an exemplary embodiment, it should be understood that the secondary package 280 may be formed in any desired shape such as various differently shaped containers, spherical holders, circular boxes, and may be from any desired material such as including all kind of papers, fiberboard, corrugated board, plastic, hybrid material, or any combinations thereof. Similarly, when adapted to hold different items, the carton 281 is sized and dimension accordingly depending upon the size and dimension requirements of the corresponding items.

Figure 4:
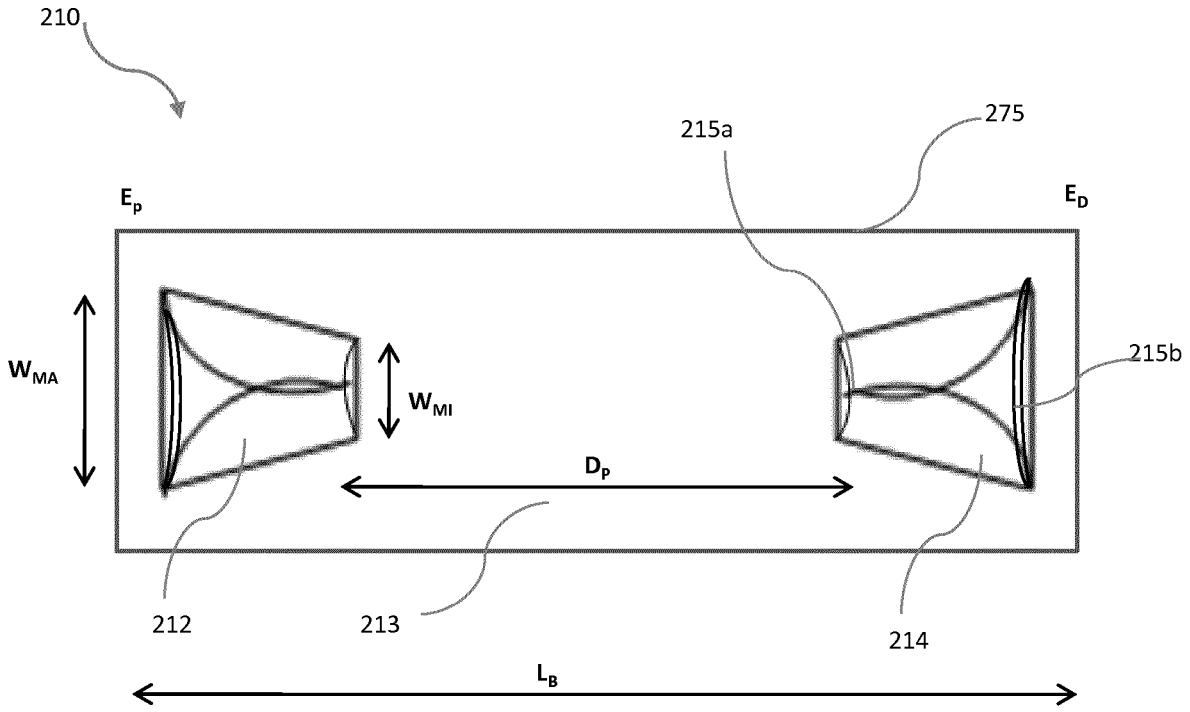
FIG. 4 is a perspective view of a pair of handle pocket positioned on a base portion, in accordance with the preferred embodiment of the present disclosure.

The handle assembly 200 includes a base portion 210 illustrated in FIG. 4, having an upper surface 213 and a lower surface 275. The base portion 210 includes a first handle pocket 212 at a proximal end $E_p$ extended towards a second handle pocket 214 at a distal end $E_d$, configured on the upper surface 213 of the base portion 210. The base portion 210 is a generally elongated piece of material adapted to serve as a bottom support of the handle assembly 200. In a preferred embodiment, the base portion 210 is formed of a single layer or a multilayered elongated piece of material selected from but not limited to one or more of all kind of papers, fiberboard, corrugated board, any kind of plastic material, a hybrid material, and the like. However, in other embodiments, the base portion 210 may be a multilayer structure such as a carton, housing and the like, formed of a material selected from one or more of but not limited to a folded blank, all kind of papers, fiberboard, corrugated board, any kind of plastic material, a hybrid material, and the like. The base portion 210, in any above-mentioned configuration is of a length $L_B$ in a direction same as of a longitudinal direction the handle opening 286, generally more than the length $L_H$ thereof.

The first handle pocket 212, and the second handle pocket 214, each is first separately formed, generally by folding a piece of material from two of its end and then gluing them together such that at least one of the end substantially overlaps the other and a recess 215 is formed therein each of the pockets 212, 214 respectively. Thereafter, the first handle pocket 212, and the second handle pocket 214, is fixed onto the upper surface 213 of the base portion 210 at a distance $D_p$ between each other, using one or more fixation mechanisms (not shown). In all such embodiments, each of the handle pockets 212, 214 may be formed of a material selected from a single layer or a multilayer structure of any kind of paper, fiberboard, corrugated board, a plastic, or any hybrid material, and/or any combination thereof, suitable for the application in accordance with the current invention without deviating from the scope thereof. Further, the one or more fixation mechanism may be selected as one or more of but not limited to gluing, retention tabs, stapling, rivets, button-based fixation mechanism, and/or any other known mechanical attachment means conventionally known in the art and suitable for use in current invention without deviating from the scope thereof.

In some preferred embodiments, each of the first handle pocket 212, and the second handle pocket 214 may be formed integrally within the base portion 210 by first cutting out two flaps within the base portion 210 and thereafter folding and gluing them together such that at least one of the flaps substantially overlaps the other and a recess 215 is formed therein each of the pockets 212, 214 respectively. Such an embodiment, being a single piece, the base portion 210, and the pockets 212, 214, inherits much more strength and capability to support the secondary package 280. In addition, the two flaps may be glued offset, e.g. one flap overlaps the other with a small offset (e.g. a few millimeters) such that, upon a consumer pulling the gripping portion, the handle is touching a pocket at two contact points, namely at the first pocket flap and at the second pocket flap, thereby reducing the shear or tear risk. The pockets 212, 214 may be formed and/or configured in any desired shape depending upon the design constraints and such that it provides a suitable strength to the handle assembly 200 in relation to base portion 210 and the carton 281. In such embodiments, the recess 215 includes an inward opening 215*a* denoting the tip of the V-shape and an outward opening 215*b* corresponding to the broad end of the V-shape. Further, in preferred embodiment, the distance $D_p$ is a distance generally more than the length $L_H$ of the handle opening 286 and lesser than length $L_B$ of the base portion 210.

Figure 5:
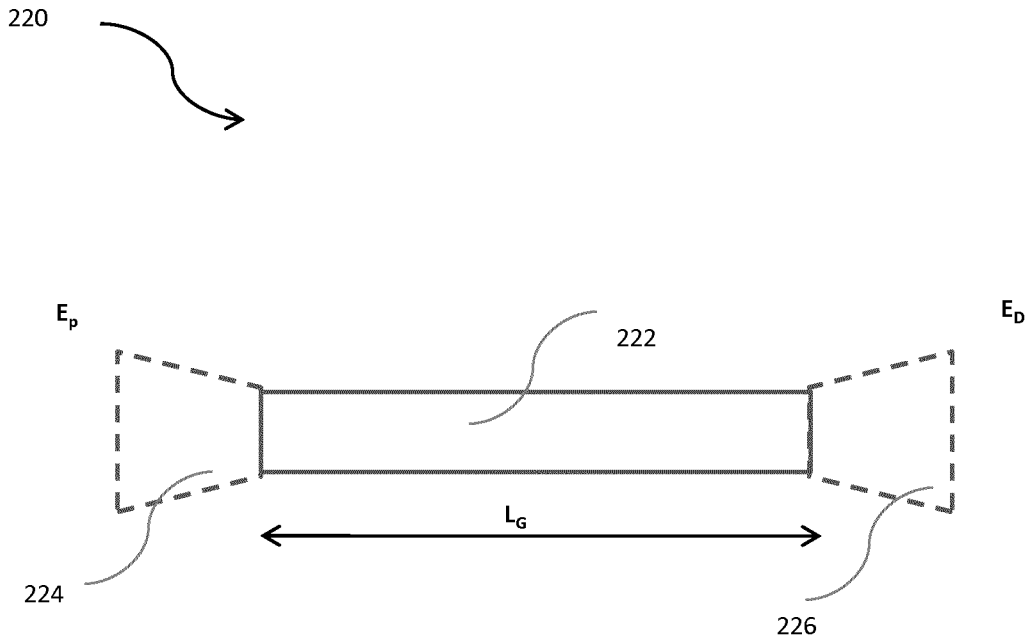
FIG. 5 illustrates a perspective view of a handle of the handle assembly in a locked state, in accordance with the preferred embodiment of the present disclosure.

The handle assembly 200 further includes a handle 220. As illustrated in FIG. 5, the handle 220 includes a gripping portion 222 having a length $L_G$ extending between a first enclosed portion 224 at the proximal end $E_p$ and a second enclosed portion 226 at the distal end one $E_d$. In some embodiments of the present invention, the gripping portion 222 has a shape easy to be grasped by the user. For example, in some instances, the gripping portion 222 may include finger grips configured thereon. while in other instances, the gripping portion 222 may include any other shape adapted to ease the handling and/or holding thereof by the user.

The enclosed portions 224, 226, of the handle is generally shaped and dimensioned complementary to the handle pockets 212, 214 such that when inserted into one of the corresponding pockets 212, 214, each of the enclosed portions 124, 126 is adapted to be slidably and lockingly movable between a free state $S_F$ (illustrated in FIG. 2*a*) and a locked state $S_L$ (illustrated in FIG. 2*b*) within the corresponding recess 115 therein. Accordingly, each of the enclosed portions 224, 226 has a minimum width lesser than a minimum width of the corresponding handle pockets 212, 214. Further, each of the enclosed portions 224, 226 has a maximum width lesser than a maximum width of the corresponding handle pockets 212, 214. Further, within the preferred embodiment, where each of the pockets 212, 214 is generally v shaped, the pockets 212, 214 has the minimum $W_{MI}$ width at the inward opening 215*a* in a direction facing the other pocket and the maximum width $W_{MA}$ at the outward opening 215*b* in a direction opposite to the inward opening. Accordingly, in such instances, the enclosed portion 224, 226, reaches its locking state at the edge of inward opening 215*a* and the free state away from the edge of the inward opening 215*a*. Further, preferably in such embodiments, each of the enclosed portions 224, 226, is adapted to be dimensioned such that it substantially covers the entire space within the recess 215.

In yet other embodiments, the enclosed portions 224, 226, may have any other possible shape as desired in accordance with the current disclosure but not limited to shapes such as hourglass shape, circular shape, v shape and the like.

In yet another embodiment, the handle assembly 200 includes one or more locking assembly [not shown] for locking the enclosed portions 224, 226, beyond a predetermined position onto the base portion 210 and preferably within the pockets 212, 214. Such embodiments are particularly suitable for the embodiments where the shape of the handle pockets 212, 214 does not provide a substantial strong locking of the corresponding enclosed portion 224, 226 there within. However, in some other embodiments, the locking assembly may be adapted to provide an additional locking mechanism in addition to clamping within the pocket. In a preferred embodiment of the present invention shown in FIG. 1, the locking assembly 127 includes a cut-hook based locking mechanism. In such embodiments, each of the enclosed portions 124, 126 includes a cut-out 128 therein at one or more edges thereof. Further, in such embodiments, the base portion 110 includes one or more hooks 129 complementary to the cutouts 128 within the enclosed portions 124, 126 and adapted to lockingly hold the enclosed portion 124, 126 when engaged with the cutouts 128. In such embodiments, and in some instances, the one or more hooks 129 are positioned within the handle pockets 112, 114. However, in some other instances, the one or more hooks 129 may be positioned at any position out of the handle pockets 112, 114, such that even if the enclosed portions 124, 126 slides out of the corresponding pockets 112, 114, accidentally or due to heavy weights, it gets locked within the one or more hooks configured out of the pockets at a predetermined position thereby avoiding the sliding of the enclosed portion beyond the predetermined position on the base portion 110. Further, in some other instances, the pockets do not have specific hooks in which case the cutouts of the enclosed portions get locked to the edges of the pocket itself. Accordingly, such locking assembly 127 further facilitates reducing the pressure onto the edges of the pockets 112, 114 and share it more with the base portions 110. In another embodiments, the locking assembly may be any suitable locking mechanism already known in the art and suitable for use with the current invention without deviating from the scope thereof.

In use, as disclosed earlier, the handle assembly 200 is adapted to be positioned within the inner surface 295. such that the gripping portion 222 of the handle 220 is visibly accessible from the handle opening 286. In some embodiments, the handle assembly is affixed to an inner surface [not shown] of the wall 282 including the handle opening 286 such that the base portion 210 overlaps the handle opening 286 from inside, and the handle pockets 212, 214 are positioned besides edges of the handle opening 286 and the gripping portion 222 is visibly accessible through the handle opening 286. In an embodiment, the handle assembly 200 is fixed to the inner surface of wall 282 at the pockets 212, 214 using one or more fixation mechanisms. In other embodiments, the handle assembly 200 is attached to an inner surface of wall 282 at the base portion 210 using one or more fixation mechanism. In yet other embodiments, the handle assembly 200 is not fixed onto the inner walls 282 and is supported onto the top of the items stored within the carton 281.

Figure 3A:
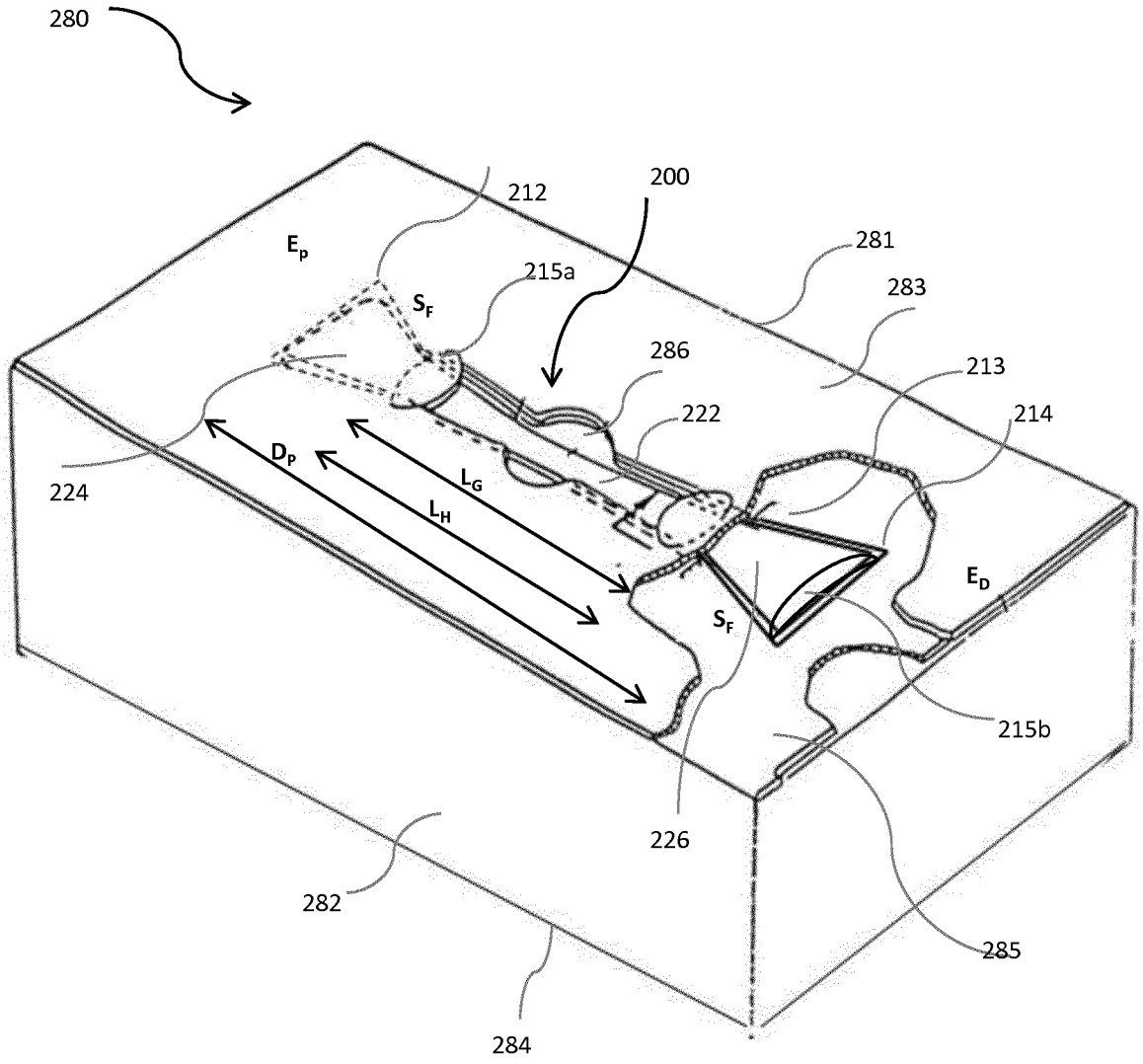
FIG. 3*a* illustrates a schematic diagram representing an exemplary packaging having a handle assembly in a free state, in accordance with another embodiment of the present disclosure.
Figure 3B:
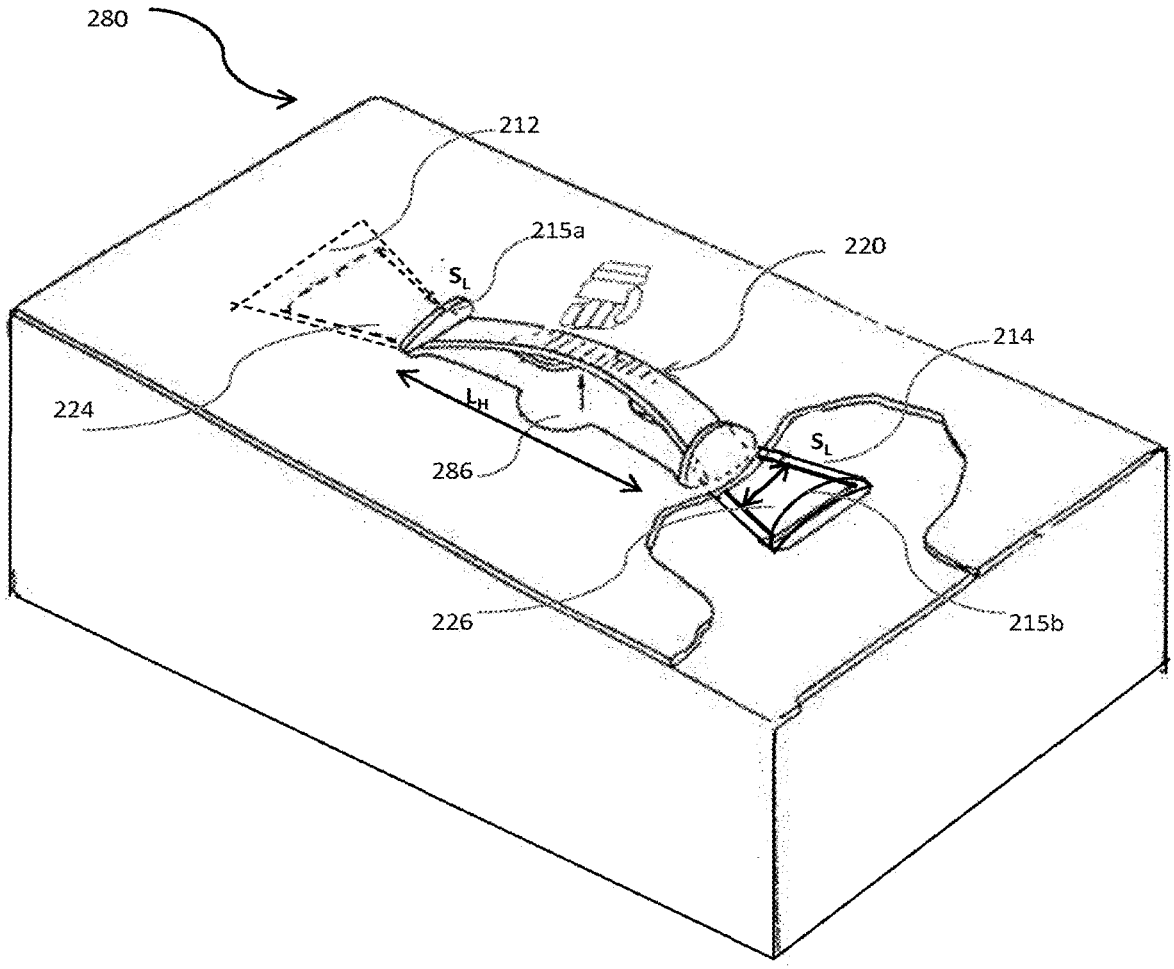
FIG. 3*b* illustrates a schematic diagram representing an exemplary packaging having a handle assembly in a locked state, in accordance with another embodiment of the present disclosure.

In a modification of the first embodiment, as illustrated in FIGS. 3*a* and 3*b*, the handle assembly 200 positioned within the secondary package 280 differ from the first embodiment in that it does not include the base portion 210. In such an embodiment, the handle assembly 200 includes the first pocket 212 and the second pocket 214 adapted to be attached onto the inner surface of the wall 282 having the handle opening 286, besides each edge thereof. Further, each of the enclosed portions 224, 226 of the handle 220 is slidingly received within at least one of the handle pockets 212, 214 and movable between the free state $S_F$ (illustrated in FIG. 3*a*) and the locked state $S_L$ (illustrated in FIG. 3*b*) therein. The modified embodiment is particularly preferred for use in applications where the secondary packages 280 is adapted for holding light weight items. Such an embodiment further reduces the cost of the handle assembly 200 as requires further lesser material due to absence of base portion 210.

FIGS. 2 and 3 schematically show the arrangement of the basic components of the secondary package 280 employing the handle assembly 200 of the present disclosure. However, in the construction of commercial functional units, secondary components such as couplers, connectors, support structure and other functional components known to one of skill in the field of packaging and more particularly the handling of packaging, may be incorporated within the secondary package 280. Such commercial arrangements are included in the present invention as long as the structural components and arrangements disclosed herein are present.

The handle 220 including the enclosed portions, 224, 226, and the gripping portion 222 may be made of any material selected from one or more of but not limited to a single layer or a multilayer structure formed of all kind of papers, paperboard, fiberboard, cardboard, carton board, board, corrugated board, plastic, and/or any hybrid material and/or a combination thereof.

In some embodiments, the handle 220 may be made of a substantial elastic material selected from one or more of but not limited to elastomeric stretchable material selected from one or more of but not limited to elastomeric material such as group of polyethylene specifically low density polyethylene, polypropylene, polyester, in particular polyalkylene terephthalates and one or more polymers selected from polymer of said elastomeric film is selected from the group consisting of poly(ethylene-butene), poly(ethylene-hexene), poly(ethylene-octene), poly(ethylene-propylene), poly(styrene-butadiene-styrene), poly(styrene-isoprene-styrene), poly(styrene-ethylene-butylene-styrene), poly(ester-ether), poly(ether-amide), poly(ethylene-vinylacetate), poly(ethylene-methylacrylate), poly(ethylene-acrylic acid), poly(ethylene butylacrylate), polyurethane, poly(ethylene-propylene-diene), and ethylene-propylene rubber, EPM (ethylene propylene rubber, a copolymer of ethylene and propylene) and EPDM rubber (ethylene propylene diene rubber, a terpolymer of ethylene, propylene and a diene-component), Epichlorohydrin rubber (ECO), Polyacrylic rubber (ACM, ABR), Silicone rubber (SI, Q, VMQ), Fluorosilicone Rubber (FVMQ), Fluoroelastomers (FKM, and FEPM) Viton, Tecnoflon, Fluorel, Aflas and Dai-El. Such an elastic property of the handle 220 allows the capability to the handle of being elongated in at least one direction, and preferably in two or more directions when the enclosed portion is locked within the pocket. Further, the elastic property further also capability of immediate retracting of the gripping portion to its original dimensions when the pulling force is removed. Preferably, the handle 220 in such embodiments have a stretching capability ranging between 5% and 20%. preferably, between a range 5% to about 15%. Such a stretching capability allows the handle 220 to be stretched to a small extent and is preferably desired to eliminate the possibility of breakage of the handle 220 on application of very high weights.

In some other embodiments, the handle 220 including the gripping portion 222 and the enclosed portions, 224 and 226, may further include a layer of water proof material coated and/or laminated thereon so as to facilitate the use of the handle assembly 200 during rainy season, and within the conditions where the handle 220 may be adapted to be come in contact with water/liquids, and the like.

The carton 281, as illustrated in FIGS. 2 and 3, is an exemplary cuboidal shaped carton having the handle openings 286 configured onto the top wall 283, in accordance with a preferred embodiment of the current disclosure. However, in other embodiments, the carton 281 may be of any other shape and having any number of sidewalls and/or handle openings 286 on any wall, as desired without deviating from the scope of the invention. In one alternate embodiment, the carton 281 is a generally cylindrical shaped having circular walls having elongated handle openings 286. In such an embodiment, the base portion 210 of the handle assembly 200 is generally adapted to bend across a pre-pressed line such that the base portion 210 coincides with the round walls of the carton 281. Further, the base portion 210 is glued onto the walls such that the gripping portion 222 of the handle 220 is visible accessible through the handle opening 286.

Figure 8:
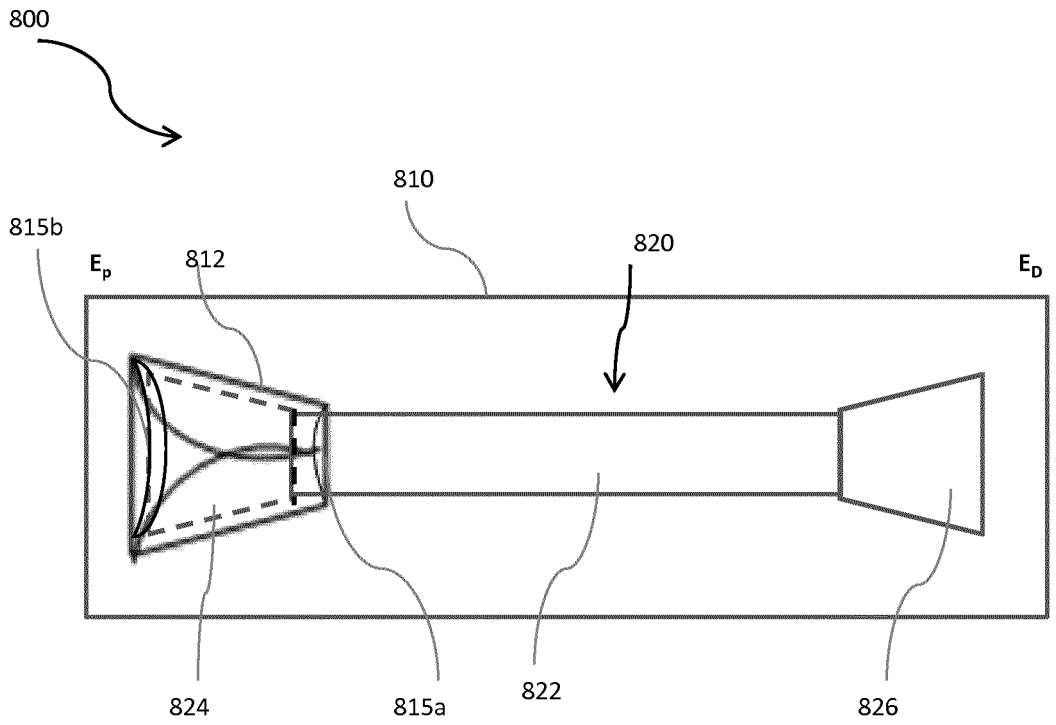
FIG. 8 illustrates a schematic diagram representing an exemplary handle assembly, in accordance with yet another embodiment of the present disclosure.
Figure 9:
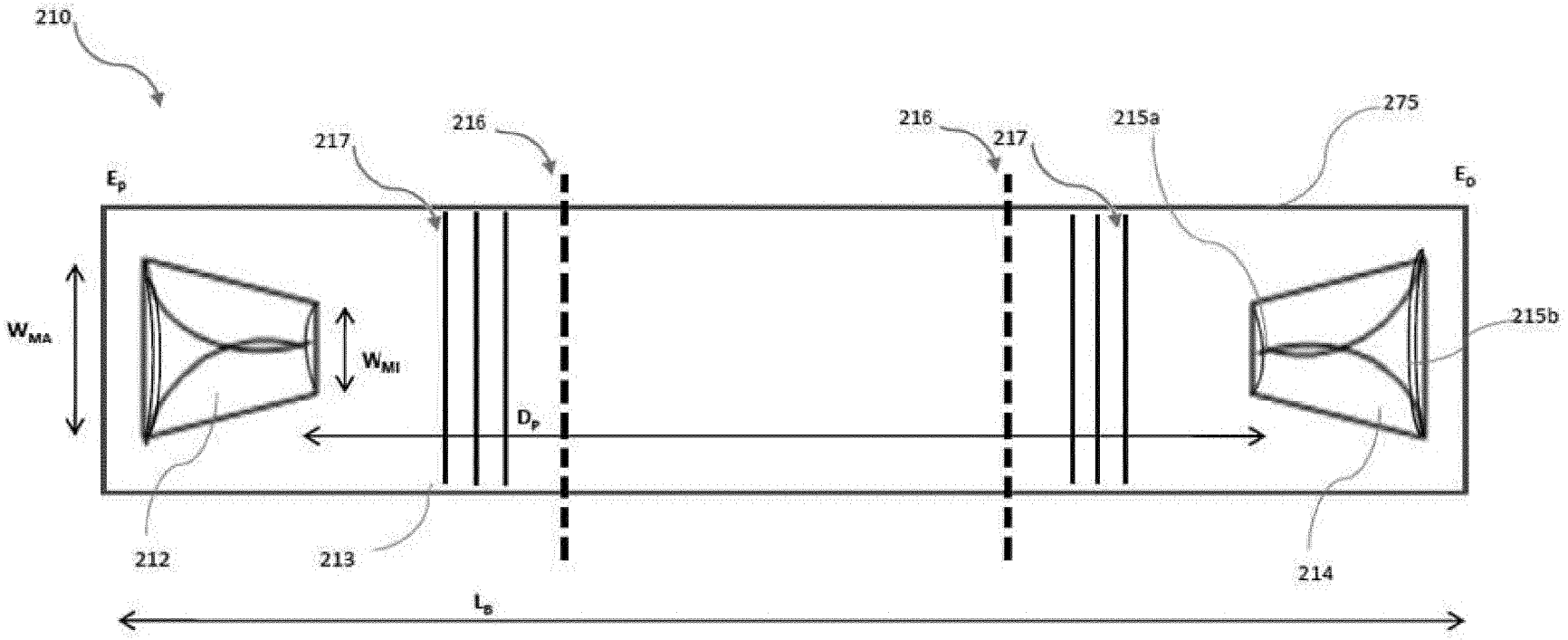
FIG. 9 illustrates a schematic diagram representing a handle assembly in accordance to another embodiment of the present disclosure.

FIG. 8 illustrates an additional exemplary embodiment disclosing a handle assembly 800. The handle assembly 800 includes a base portion 810, having an upper surface 813 and a lower surface 875. The base portion 810 includes a first handle pocket 212 having a recess 815, positioned at a proximal end $E_p$, configured on the upper surface 813 of the base portion 810. The first handle pocket 812 may be a pocket manufactured separately and then adhered to the base portion, or otherwise may be formed integrally within the base portion 810 as disclosed earlier.

The handle assembly 800 further includes a handle 820 having a gripping portion 822 extending between a first enclosed portion 824 at the proximal end $E_p$ and a second enclosed portion 826 at a distal end $E_d$.

The enclosed portion 824 is shaped and dimensioned complementary to the handle pocket 812 such that when inserted therein, the enclosed portion 824 is adapted to be slidably and lockingly movable between a free state $S_F$ and a locked state $S_L$ within the recess 815. The fixed portion 826 is fixedly adhered onto the upper surface 813 of the base portion 810 at the distal end $E_d$ and is therefore immovable with respect to the base portion 810.

Accordingly, in such an embodiment, when a user lifts the handle 820, the gripping portion 822 is lifted upward such that the enclosed portion 824 slidingly extends out towards a position where it is in its locked state $S_L$ whereas the fixed portion 826 remains fixedly adhered to the base portion 810. Therefore, when the user releases the handle 820, the gripping portion 822 retracts back and the enclosed portions 824 slides back to its free state $S_F$ within the pocket 812.

It is to be contemplated that the current invention may be executed using any combination of pockets at any end. Further, when not fixedly attached as disclosed within embodiment of FIG. 8, the movement of each of the enclosed portions may be limited to a predetermined extent and/or position on the base portion 810, either by modifying the shape of the pockets and/or enclosed portions, or by using one or more locking mechanisms as disclosed earlier.

Figure 6:
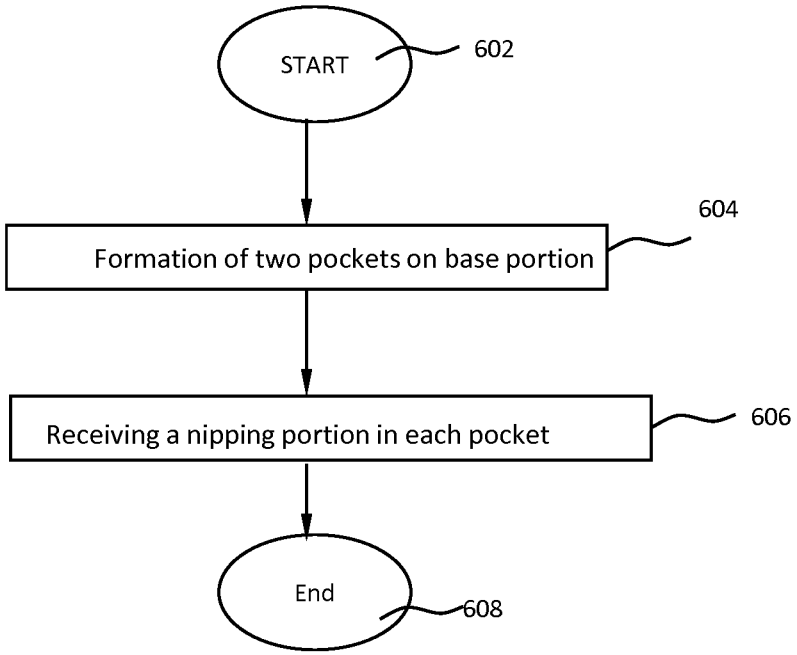
FIG. 6 depicts a flowchart illustrating the steps assembling the handle assembly, in accordance with an embodiment of the present disclosure.

FIG. 6 with reference to FIGS. 1 through 5, is a flow diagram illustrating a method 600 of assembling the handle assembly 200 of the present disclosure. The method starts at step 602 and proceeds to step 604 where the base portion 210 is configured with two spaced apart handle pockets 212, 214. In an embodiment the handle pockets 212, 214 may be formed by folding a piece of material and then gluing it. In another embodiment, the two spaced apart pockets 212, 214, may be formed by cutting out two pair of flaps within the base portion 210, and at a predetermined distance $D_p$ from each other. Thereafter, each of the pair of flap is folded together in substantially overlapping relationship to form a handle pocket using each of the pair of the flaps. Once the first pocket 212 and the second pocket 214 is formed/fixed on the upper surface 213 of the base portion 210, the method proceeds to step 606 where the handle 220 is received onto the base portion 210. The step 606 further includes slidingly receiving each of the enclosed portions 224, 226 of the handle 220 within at least one of the first pocket 212 and the second pocket 214 such that each of the enclosed portions 224, 226 is slidingly and lockingly clamped within the corresponding handle pocket 212, 214. In an embodiment of the present embodiments where the inward opening 215*a* of the recess 215 has a width lesser than the maximum width of the enclosed portions 224, 226, each of the enclosed portions 224, 226 is forcibly slide into the recess 215. Further in some embodiments, in such instances, the enclosed portions 224, 226 may be temporarily folded and then inserted into the corresponding recess 215 such that when received within the corresponding pocket 212, 214, the enclosed portions 224, 226 gets unfolded and therefore clamped there within. Once both the enclosed portions 224, 226 are slidably locked within the corresponding handle pockets 212, 214, the handle assembly 200 may be used with one or more packages/containers for facilitating handling/gripping/lifting thereof. In some embodiments of the present invention, the step 606 of receiving the enclosed portions 224, 226 onto the piece of material for forming the pockets, at each of the end and thereafter, the pockets 212, 214 is formed there around by folding and gluing the material as disclosed within the step 604. In yet other embodiments, of the present invention, each of the step of the method 600 may be performed in any desired order, sequentially, and/or simultaneously.

Figure 7:
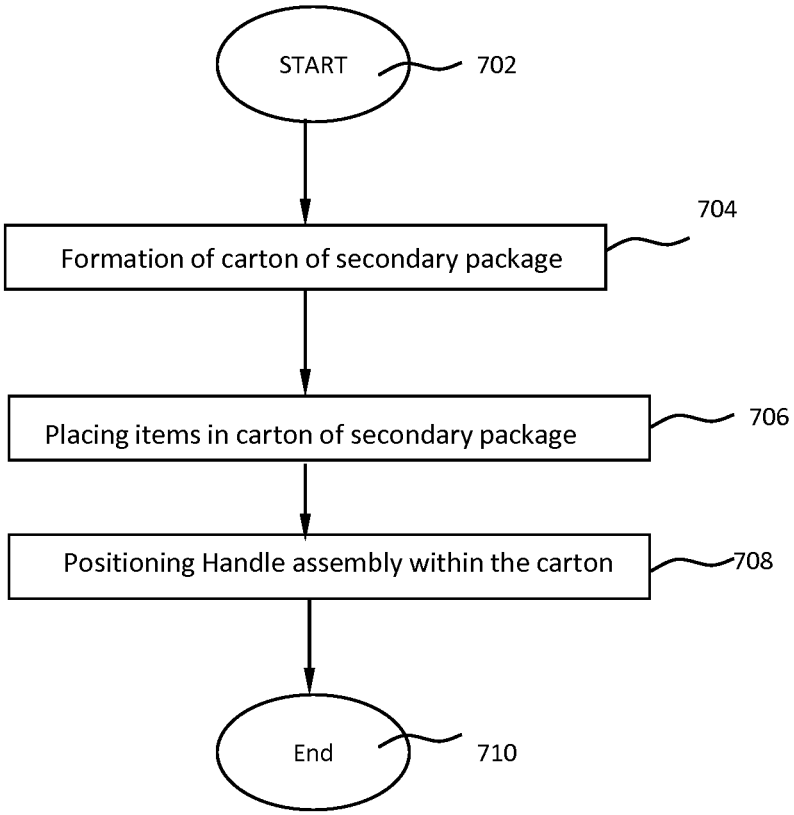
FIG. 7 depicts a flowchart illustrating the steps for installing the handle assembly into a secondary packaging, in accordance with an embodiment of the present disclosure.

FIG. 7 illustrates a method 700 of assembling the secondary package 280 employing handle assembly 200 of the present disclosure. The method starts at step 702 and proceeds to step 704 where the carton 281 is receiving and/or formed, the carton 281 having one or more handle openings 286 configured in one of its plurality of walls 282. The method 700 then proceeds to step 706 where a plurality of items such as for example, beverage containers, are placed within the inner surface 295 of the carton 281 and arranged in a predetermined row and column configuration. Thereafter, at step 708. the handle assembly 200 is positioned within the inner surface 295 of the carton 281 such that the gripping portion 222 is accessible from the handle opening/elongated slot 286. In an embodiment, the handle assembly 200 may be fixed onto the inner surface of the carton wall 282 using one or fixation mechanism as already disclosed. In other embodiments, the handle assembly 200 may be simply placed onto the top of items placed within the carton 281. Such an embodiment, is particularly feasible when the items stored within the carton 281 covers a significant height of the carton 281 such that the gripping portion 222 may be accessible to be gripped by a user through the handle opening 286. In use, the secondary package 280 is lifted up by stretching the gripping portion 222 out of the handle opening 286 which in turns stretches each of the enclosed portions 224, 226, from its free state $S_F$ to its locked state $S_L$ such that when in its locked state, the enclosed portions, 224, 226, the pockets 212, 214, and the base portion 210 shares the load of the force applied by the user. As may be seen, in the above disclosed method, the secondary package 280 is formed first and filled with the plurality of items and thereafter, the handle assembly 200 is installed within the wall having the handle opening. However, in some embodiments of the present invention, handle assembly 200 is first assembled into the secondary packaging 280 using a method as disclosed in step 708. Thereafter, the secondary container 280 is filled with the plurality of items as desired.

In yet other embodiments of the present inventions, each of the step of the method 700 may be performed in any desired order, sequentially, and/or simultaneously.

INDUSTRIAL APPLICABILITY

The present disclosure relates to a handle assembly 200 formed of two spaced apart handle pockets configured onto a base portion, and having a handle 220, for facilitating handling of a secondary package 280 enclosing and securely carrying various items such as food items, house hold items, and any other group of items packed together as a group. Primarily, the secondary packaging is utilized for holding liquid containers, such as beer, wine, cider, hard liquor (e.g., distilled beverage, spirit, liquor, hard alcohol, etc.), soft drinks (e.g., cola, soda, pop, tonic, seltzer), iced tea, soda water and other types of carbonated/non-carbonated beverages. The handle assembly 200 while being cost-efficient and portable, is very quick and easy to be assembled by retail consumers, or by the retailers, and offers an easy yet comfortable shipping, handling and transporting of packages of any shape, size or any variety of configurations. While the secondary package 280 is described primarily for holding and carrying beverage containers, it is also contemplated for a person skilled in the art that the secondary package 280 of the current disclosure may be implemented in various industries such as food industry, transport industry, house hold appliance industry in transportation of any kind of product or group of products, of any shape, size or any variety of configurations, without limiting it to the beverage industry.

As should be appreciated, the realization of such a handle 400 for the secondary packages allows the end consumer to safely, easily and comfortably pick up and carry the cartons having a plurality of items stored therein. Further, the handle being locked with multiple pockets and the base portion supported on the items stored within the carton, does not break up even when very heavy weight is placed therein the carton. Generally, the presence of the base portion for supporting the handle facilitates the possibility of heavy weight not impacting the material of the wall having the handle, during carriage and transportation. Further, since the base portion, including the pockets, and the handle may be a multilayer structure, thereby offering further increasing the strength of the handle assembly and thereby allowing the possibility of making the cartons with very soft and cheap quality of paperboards, cardboards, and the like. Additionally, since the handle of the handle assembly of the current disclosure retracts within the carton when not in use, facilitates the possibility of easily stacking the packages to be stacked during transportation and therefore provides an increase flexibility as well as efficiency during the transportation.

While the flexible handle 200 of current disclosure has been disclosed in reference to the secondary package 280 of the current disclosure. it may also be used as an independent self-sustaining unit. Further it can be integrated with various suitable containers known in the art including various carton formed from foldable blank as well as cartons constructed of materials such as fabric, woven material, non-woven material, woven metallic fabric that may include ferrous or nonferrous metals, etc., or any other suitable material. In such embodiments too, the handle assembly 200 of the current disclosure may be used to securely carry the secondary package 280 without deviating the scope of the current disclosure.

Further, while the currently illustrated exemplary secondary package discloses a single handle having a gripping portion extending out of one of the walls thereof. It is to be contemplated that any number of handles, on any of the wall of the secondary package including the top wall and the bottom wall may be realized in accordance with the design constraints without deviating from the scope of the current disclosure.

We claim:

1. A handle assembly, the assembly comprising:

a base portion comprising a first handle pocket at a proximal end extended towards a second handle pocket at a distal end, each of the pockets comprising a recess with an outward opening and an inward opening;

a handle comprising a gripping portion extending towards a first enclosed portion at the proximal and a second enclosed portion at the distal end;

wherein each of the enclosed portions is slidingly locked within at least one of the handle pockets such that when the gripping portion is lifted up, at least one of the enclosed portions slides out to a locked state and moves back to a free state when the griping portion is released and retracted back, characterized in that each of the pockets is a generally V-shaped hollow pocket, and wherein each of the enclosed portions is generally V-shaped and geometrically similar to the V-shaped handle pockets, and whereby the legs of the V-shaped handle pockets are oriented at a minimal angle of 15° and at a maximal angle of 60° with respect to the longitudinal axis of the base portion;

wherein each of the pockets is formed by cutting out two flaps within the base portion and then folding and gluing together the two flaps such that the recess is formed there within.

2. The handle assembly according to claim 1, wherein the base portion is a generally single layer/multilayer elongated piece of a material selected from paper, cardboard, carton, fiber board, corrugated carton, plastic, and metal.

3. The handle assembly according to claim 1, wherein each of the pockets is fixed onto the base portion at a distance generally greater a length of the handle.

4. The handle assembly according to claim 1, wherein the base portion comprises a double-folded section towards the proximal end and positioned between the first handle pocket and the proximal end itself, and/or comprises a double-folded section towards the distal end positioned between the second handle pocket and the distal end itself, wherein the double-folded section comprises fold lines substantially perpendicular to the longitudinal axis of the base portion, thereby creating an overlapping Z-shaped double-folded section.

5. The handle assembly of claim 4, wherein at least one overlapping zones of the double-folded section are releasably interconnected to each other via an adhesive or fixation means.

6. The handle assembly according to claim 5, wherein all of the overlapping zones of the double-folded section are releasably interconnected to each other via the adhesive or the fixation means.

7. The handle according to claim 1, wherein each of the pockets is formed by folding and then gluing a piece of a material such that the recess is formed there within.

8. The handle assembly according to claim 7, wherein the piece of material is selected from one or more of papers, cardboard, carton, fiber board, corrugated carton, and plastic.

9. The handle assembly according to claim 1, wherein each of hollow pocket has a minimum width greater than a minimum width and a maximum width greater than a maximum width of each of the enclosed portions of the handle.

10. The handle assembly according to claim 1, wherein the handle is made of a material selected from paper, cardboard, carton, fiber board, corrugated carton, and plastic.

11. The handle assembly according to claim 1, further comprising a locking mechanism for locking the enclosed portions beyond a predetermined position onto the base portion.

12. The handle assembly according to claim 11, wherein the locking mechanism comprising a cutout within the enclosed portion and a locking hook configured onto the base portion.

13. A secondary packaging comprising a handle assembly for said secondary packaging according to claim 1, the secondary packaging comprising a plurality of walls and having at least an recessed slot within one of its wall, wherein the handle assembly is adapted to be positioned at an inner surface of the wall comprising the recessed slot such that the gripping portion of the handle is accessible through the recessed slot wherein further when the gripping portion is lifted up, at least one of the enclosed portions slides out to a locked state and moves back to a free state when the griping portion is released and retracted back.

14. The secondary packaging according to claim 13, wherein the secondary packaging comprising a carton formed of one or more material selected from foldable blank, paperboard, cardboard, corrugated board, plastic and paper.

15. The secondary packaging according to claim 14, wherein the handle assembly is fixed onto the inner surface of the wall of the secondary packaging using a fixation mechanism selected from one or more of gluing, adhesive patches, retention tab, stapling, and rivets.

16. The handle assembly according to claim 1, wherein the minimal angle is 20°.

17. A handle assembly, the assembly comprising:

a base portion comprising a handle pocket at a proximal end and extended towards a distal end, said pocket comprising a recess;

a handle comprising a gripping portion extending towards an enclosed portion at the proximal end and a fixed portion at the distal end wherein the enclosed portion is slidingly locked within the handle pocket such that when the gripping portion is lifted up, the enclosed portion slides out to a locked state and moves back to a free state when the griping portion is released and retracted back;

wherein the handle pocket is formed by cutting out two flaps within the base portion and then folding and gluing together the two flaps such that the recess is formed there within.

* * * * *